US007521992B1

(12) United States Patent
Hagleitner et al.

(10) Patent No.: US 7,521,992 B1
(45) Date of Patent: Apr. 21, 2009

(54) CURRENT-INTEGRATING AMPLIFIER

(75) Inventors: Christoph Hagleitner, Zug (CH); Christian I. Menolfi, Langnau am Albis (CH); Thomas H. Toifl, Zurich (CH)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/181,532

(22) Filed: Jul. 29, 2008

(51) Int. Cl.
*G06G 7/12* (2006.01)
*G06G 7/26* (2006.01)

(52) U.S. Cl. ..... 327/563; 330/253

(58) Field of Classification Search ..... 327/560–563; 330/252–253
See application file for complete search history.

(56) References Cited

U.S. PATENT DOCUMENTS 6,664,853 B1 * 12/2003 Sun et al. ..... 330/253
6,750,702 B2 * 6/2004 Massei ..... 327/563
7,034,606 B2 * 4/2006 Caresosa et al. ..... 327/563
7,336,214 B2 2/2008 Krymski
7,385,426 B1 6/2008 Wan et al.

* cited by examiner

*Primary Examiner*—Quan Tra
(74) *Attorney, Agent, or Firm*—Yee & Associates, P.C.; Jesse Abzug

(57) ABSTRACT

A current-integrating amplifier is provided. The current-integrating amplifier comprises a pair of input voltage nodes having a voltage difference there between; A pair of current sources that generate a current that produces a voltage drop over a resistor that corresponds to an equivalent voltage difference between the pair of input voltage nodes; a pair of output voltage nodes; a pair of pMOSFETs connected to the pair of output voltage nodes; a first pair of nMOSFETs connected the pair of output voltage nodes, the pair of pMOSFETS, the pair of input voltage nodes, a resistor, and a second pair of nMOSFETS; a resistor connected to the pair of current sources; a second pair of nMOSFETs connected to the first and third pairs of nMOSFETs; and a third pair of nMOSFETs connected to the second pair of nMOSFETs and connected to a bias generator that provides a predetermined constant current.

1 Claim, 1 Drawing Sheet

CURRENT-INTEGRATING AMPLIFIER

BACKGROUND OF THE INVENTION

1. Field of the Invention

The present invention relates generally to electronic circuits and more specifically to current-integrating amplifiers.

2. Description of the Related Art

In electronic circuits such as an analog-to-digital converter (ADC) or a decision feedback equalizer (DFE), it is frequently required to (a) drive a given capacitive load with an input signal, and at the same time (b) provide amplification, and (c) provide a well-defined voltage offset to the signal. All three functions can be achieved with the present invention with low power consumption.

BRIEF SUMMARY OF THE INVENTION

According to one embodiment of the present invention, a current-integrating amplifier comprises first and second input voltage nodes having a voltage difference there between; first and second current sources wherein the first and second current sources generate a current that produces a voltage drop that corresponds to an equivalent voltage difference between the first and second input voltage nodes; first and second output voltage nodes; a first p-type metal-oxide-semiconductor field-effect transistor (pMOSFET), having a drain connected to the first output voltage node and having a gate that receives a clock signal that varies between a high signal and a low signal; a second pMOSFET having a drain connected to the second output voltage node and having a gate that receives a clock signal that varies between a high signal and a low signal; wherein the first and second pMOSFET reset the first and second output voltage nodes in response to receiving a low frequency signal; a first n-type metal-oxide-semiconductor field-effect transistor (nMOSFET), having a drain connected to the first output voltage node and the drain of the first pMOSFET and having a gate connected to the first input voltage node; a second nMOSFET having a drain connected to the second output voltage node and the drain of the second pMOSFET and having a gate connected to the second input voltage node; wherein the first and second nMOSFET produce a differential output current that is proportional to the difference between the first and second input voltage nodes, wherein the differential output current is integrated on a load capacitance of the first and second pMOSFET when the first and second pMOSFET receive a high signal; a resistor connected to the first and second current sources wherein current from the first current source flows across the resistor and into the second current source; wherein a body voltage of the first nMOSFET is connected to a source of the second nMOSFET at a first end of the resistor where the voltage drop from the generated current is applied and wherein a body voltage of the second nMOSFET is connected to a source of the first nMOSFET and a second end of the resistor where the voltage drop from the generated current is applied; a third nMOSFET, having a drain connected to the source of the first nMOSFET and having a gate that receives a clock signal that varies between a high signal and a low signal; a fourth nMOSFET having a drain connected to the source of the second nMOSFET and having a gate that receives a clock signal that varies between a high signal and a low signal; wherein the third and fourth nMOFSET are activated in response to the third and fourth nMOFSET receiving a high signal; a fifth nMOSFET having a drain connected to the source of the third nMOSFET, and having a gate connected to a bias generator that provides a predetermined constant current; a sixth nMOSFET having a drain connected to the source of the fourth nMOSFET, and having a gate connected to a bias generator that provides a predetermined constant current; and wherein the predetermined constant current flows from the fifth and sixth nMOSFETs in response to the third and fourth nMOFSETs receiving a high signal.

DETAILED DESCRIPTION OF THE INVENTION

Figure 1:
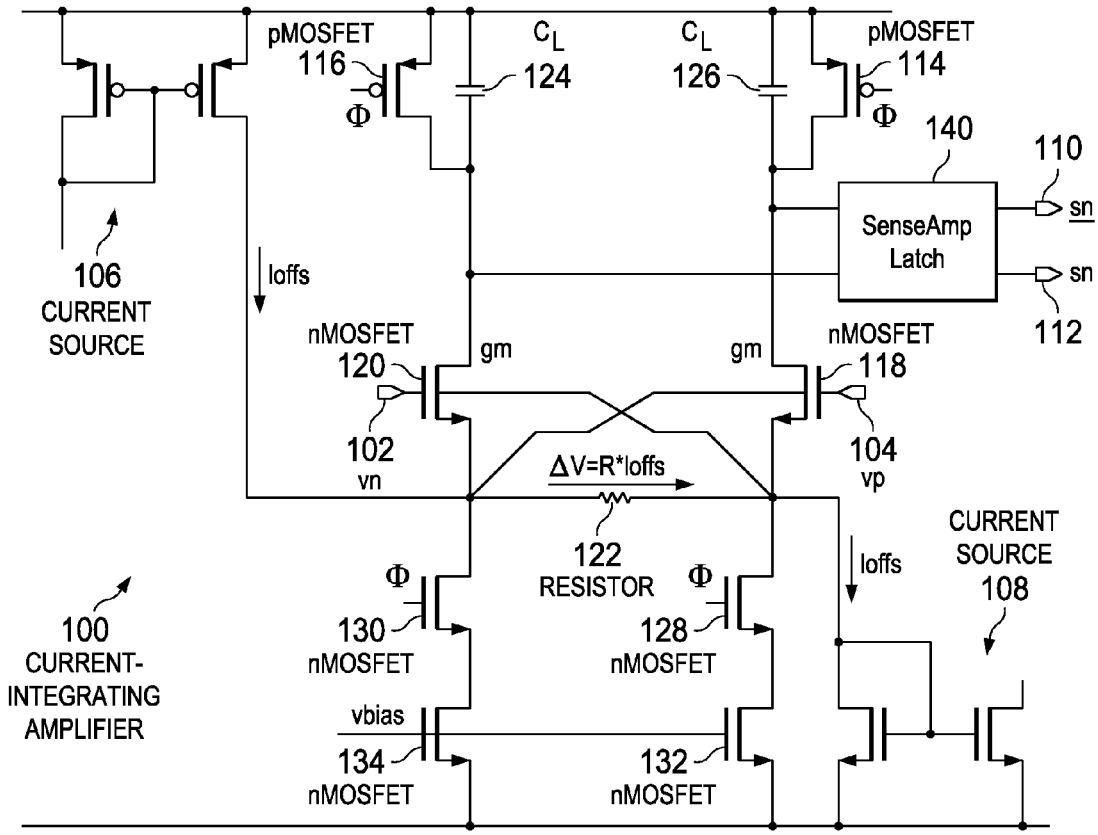
FIG. 1 is a block diagram of a current-integrating amplifier with offset adder in accordance with an exemplary embodiment.

Exemplary embodiments provide a current-integrating amplifier. Exemplary embodiments utilize a body voltage shift that provides additional voltage shift without compromising gain. In an exemplary embodiment, a voltage shift at the input of the current-integrating amplifier allows the gain to set at greater than 1. Exemplary embodiments may be used in an analog-to-digital converter circuit (ADC) or decision-feedback equalizer (DFE) circuit which may be part of a data receiver circuit FIG. 1 is a block diagram of a current-integrating amplifier in accordance with an exemplary embodiment. Current-integrating amplifier 100 is a current-integrating amplifier with offset adder. Current-integrating amplifier 100 comprises input voltage nodes, vn 102 and vp 104, current sources 106 and 108, output voltage nodes, sn 110 and 112, two p-type metal-oxide-semiconductor field-effect transistor (pMOSFET), pMOSFETs 114 and 116, six n-type metal-oxide-semiconductor field-effect transistor (nMOSFET), nMOSFETs 118, 120, 128, 130, 132, 134, load capacitances $C_L$ 124 and $C_L$ 126, and resistor 122. In an exemplary embodiment, current-integrating amplifier 100 is connected to sense amplifier latch 140, which decides if the differential voltage sn (110)-sn bar (112) is positive or negative.

Input voltage nodes vn 102 and vp 104 have a voltage difference between them. Current sources 106 and 108 generate a current that produces a voltage drop that corresponds to the equivalent voltage difference between input voltage nodes vn 102 and vp 104. pMOSFET 114 has a drain connected to output voltage node sn 110, a source connected to current source 106, and a gate that receives a clock signal $\phi$ from a clock. Clock signal $\phi$ varies between a high signal and a low signal. pMOSFET 114 has a load capacitance $C_L$ 126. pMOSFET 116 has a drain connected to output voltage node sn 112, a source connected to current source 106, and a gate that receives a clock signal $\phi$ from a clock. pMOSFET 116 has a load capacitance $C_L$ 124. pMOSFETs 114 and 116 reset output voltage nodes sn 110 and sn 112 in response to receiving a low clock signal.

nMOSFET 118 has a drain connected to output voltage node sn 110 and the drain of pMOSET 114. The source of nMOSFET 118 is connected to current sources 106 and 108, resistor 122, the source of nMOSFET 128, and the body voltage of nMOSFET 120. The gate of nMOSFET 118 is connected to input voltage source vp 104. nMOSFET 120 has a drain connected to output voltage node sn 112 and the drain of pMOSET 116. The source of nMOSFET 120 is connected to current sources 106 and 108, resistor 122, the source of nMOSFET 130, and the body voltage of nMOSFET 118. The gate of nMOSFET 120 is connected to input voltage source vn 102.

nMOSFETs 118 and 120 produce a differential output current that is proportional to the difference between the first and second input voltage nodes, vn 102 and vp 104. The differential output current is integrated on load capacitances $C_L$ 124 and $C_L$ 126 of the pMOSFETs 116 and 114, respectively, when pMOSFETs 116 and 114 receive a high signal from the clock.

Resistor 122 is connected to the current sources 106 and 108 such that current, shown as Ioffs in FIG. 1, from the current source 106 flows across resistor 122 and into current source 108. However, in an alternate embodiment, resistor 122 is connected to the current sources 106 and 108 such that current from the current source 108 flows across resistor 122 and into current source 106. The body voltage of nMOSFET 118 is connected to the source of nMOSFET 120 at a first end of resistor 122 where the voltage drop from the generated current is applied. The body voltage of nMOSFET 120 is connected to the source of nMOSFET 118 at a second end of resistor 122 where the voltage drop from the generated current is applied.

nMOSFET 128 has a drain connected to the source of nMOSFET 118. The source of nMOSFET 128 is connected to the drain of nMOSFET 132. The gate of nMOSFET 128 receives a clock signal ϕ from a clock. Clock signal ϕ varies between a high signal and a low signal. nMOSFET 130 has a drain connected to the source of nMOSFET 120. The source of nMOSFET 130 is connected to the drain of nMOSFET 134. The gate of nMOSFET 130 receives a clock signal ϕ from a clock.

nMOSFET 132 has a drain connected to the source of nMOSFET 128. The source of nMOSFET 132 is connected to current source 108. The gate of nMOSFET 132 is connected to a bias generator (not shown) that provides a predetermined constant current, shown as vbias in FIG. 1. nMOSFET 134 has a drain connected to the source of nMOSFET 130. The source of nMOSFET 134 is connected to current source 108. The gate of nMOSFET 132 is connected to a bias generator (not shown) that provides a predetermined constant current, shown as vbias in FIG. 1. The predetermined constant volatage, vbias, flows from nMOSFETs 132 and 134 in response to nMOSFETS 128 and 130 receiving a high signal.

In FIG. 1, each clock signal ϕ comes from a clock, which is not shown in the figure. In an exemplary embodiment, all clock signals ϕ come from the same clock. Clock signal ϕ varies between a high signal and a low signal.

Current Ioffs flows through resistor 122, which generates a voltage offset ΔV. The amount of voltage offset can calculated using the formula ΔV=R*Ioffs, where R is the resistance of resistor 122. Additional voltage offset may be introduced by changing the body potential of nMOSFETs 118 and 120. This additional voltage offset shift allows for the gain of current-integrating amplifier 100 to set at greater than one. Further, the body voltage shift provides additional voltage shift without compromising gain.

Current-integrating amplifier 100 has two cycles, one in which the clock signal ϕ is high, the second in which the clock signal ϕ is low. In the first cycle, when the clock signal ϕ is high, the input voltage is integrated on the load capacitors $C_L$ 124 and 126 plus an offset voltage, thereby providing amplification proportional to the integration time. In the second cycle, when clock signal ϕ is low, the output voltage nodes sn 110 and sn 112 are reset, which erases the memory of the previous state.

The amplification of the circuit is given by $$\frac{\Delta V}{Vin} = g_m \frac{\Delta t}{C_L}, \tag{1}$$

where $g_m$ is the transconductance of the transistors in the differential pair, $C_L$ is the overall load capacitance of the stage, and Δt is the integration period, which is related to the conversion frequency $f_c$ by $$\Delta t = \frac{1}{2f_c}. \tag{2}$$

The benefit of the integrating shifter can immediately be seen by setting the voltage gain in equation (1) to unity and calculating the ratio of the capacitance seen at the input of the stage $C_g$, and the load capacitance $C_L$, $$\frac{C_L}{C_g} = \frac{f_t}{2f_c},$$

where $$f_t = \frac{g_m}{C_g}$$

is the transit frequency of the transistor in the specific bias point.

Figure 2:
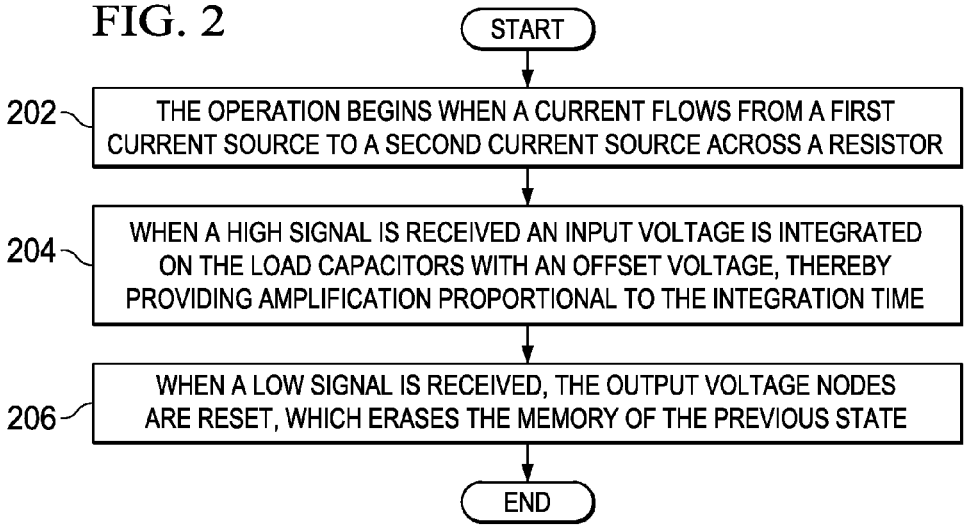
FIG. 2 is a flowchart illustrating the operation of a current-integrating amplifier with offset adder in accordance with an exemplary embodiment.

FIG. 2 is a flowchart illustrating the operation of a current-integrating amplifier in accordance with an exemplary embodiment. The operation of FIG. 2 may be performed in a current-integrating amplifier, such as current-integrating amplifier 100 in FIG. 1. The operation begins when a current flows from a first current source to a second current source across a resistor (step 202). A third pair of nMOSFETs receives a predetermined contestant voltage. A second pair of nMOSFETs receives a clock signal that varies between a high signal and a low signal. When a high signal is received an input voltage is integrated on the load capacitors with an offset voltage, thereby providing amplification proportional to the integration time (step 204). The high signal is a high clock signal. When a low signal is received, the output voltage nodes are reset, which erases the memory of the previous state (step 206) and the operation ends.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A current-integrating amplifier comprising:

first and second input voltage nodes having a voltage difference there between;

first and second current sources;

wherein the first and second current sources generate a current that produces a voltage drop that corresponds to an equivalent voltage difference between the first and second input voltage nodes;

first and second output voltage nodes;

a first p-type metal-oxide-semiconductor field-effect transistor (pMOSFET), having a drain connected to the first output voltage node and having a gate that receives a clock signal that varies between a high signal and a low signal;

a second pMOSFET having a drain connected to the second output voltage node and having a gate that receives the clock signal that varies between the high signal and the low signal;

wherein the first and second pMOSFET reset the first and second output voltage nodes in response to receiving the low signal;

a first n-type metal-oxide-semiconductor field-effect transistor (nMOSFET), having a drain connected to the first output voltage node and the drain of the first pMOSFET and having a gate connected to the first input voltage node;

a second nMOSFET having a drain connected to the second output voltage node and the drain of the second pMOSFET and having a gate connected to the second input voltage node;

wherein the first and second nMOSFET produce a differential output current that is proportional to the difference between the first and second input voltage nodes, wherein the differential output current is integrated on a load capacitance of the first and second pMOSFET when the first and second pMOSFET receive the high signal;

a resistor connected to the first and second current sources wherein current from the first current source flows across the resistor and into the second current source;

wherein a body voltage of the first nMOSFET is connected to a source of the second nMOSFET at a first end of the resistor where the voltage drop from the generated current is applied and wherein a body voltage of the second nMOSFET is connected to a source of the first nMOSFET and a second end of the resistor where the voltage drop from the generated current is applied;

a third nMOSFET, having a drain connected to the source of the first nMOSFET and having a gate that receives the clock signal that varies between the high signal and the low signal;

a fourth nMOSFET having a drain connected to the source of the second nMOSFET and having a gate that receives the clock signal that varies between the high signal and the low signal;

wherein the third and fourth nMOFSET are activated in response to the third and fourth nMOFSET receiving the high signal;

a fifth nMOSFET having a drain connected to the source of the third nMOSFET, and having a gate connected to a bias generator that provides a predetermined constant current;

a sixth nMOSFET having a drain connected to the source of the fourth nMOSFET, and having a gate connected to the bias generator that provides the predetermined constant current; and wherein the predetermined constant current flows from the fifth and sixth nMOSFETs in response to the third and fourth nMOFSETs receiving the high signal.

* * * * *